US006874648B2

(12) United States Patent
Willingham et al.

(10) Patent No.: US 6,874,648 B2
(45) Date of Patent: Apr. 5, 2005

(54) CLOSURE WITH GAS-BARRIER LINER AND PACKAGE INCORPORATING SAME

(75) Inventors: Wendell D. Willingham, Perrysburg, OH (US); Rodney M. Druitt, Warwickshire (GB)

(73) Assignee: Owens-Illinois Closure Inc., Toledo, OH (US)

( * ) Notice: Subject to any disclaimer, the term of this patent is extended or adjusted under 35 U.S.C. 154(b) by 55 days.

(21) Appl. No.: 09/960,069

(22) Filed: Sep. 21, 2001

(65) Prior Publication Data

US 2003/0057175 A1 Mar. 27, 2003

(51) Int. Cl.[7] ..... B65D 53/00; B65D 53/04
(52) U.S. Cl. ..... 215/344; 215/350; 215/DIG. 1
(58) Field of Search ..... 215/341, 343, 215/344, 349, 350, DIG. 1

(56) References Cited

U.S. PATENT DOCUMENTS

| | | | | |
|---|---|---|---|---|
| 3,782,575 A | * | 1/1974 | Braun | 215/344 |
| 4,629,083 A | | 12/1986 | Druitt | |
| 4,721,221 A | | 1/1988 | Barriac | |
| 4,756,437 A | | 7/1988 | Rossi-Mossuti | |
| 5,143,763 A | * | 9/1992 | Yamada et al. | 215/349 |
| 5,176,271 A | * | 1/1993 | Painchaud et al. | 215/350 |
| 5,356,021 A | | 10/1994 | McBride et al. | |
| 5,439,126 A | | 8/1995 | Brownbill | |
| 5,609,263 A | * | 3/1997 | Perchepied | 215/344 |
| 5,638,972 A | | 6/1997 | Druitt | |
| 5,676,269 A | | 10/1997 | Blake et al. | |
| 5,743,420 A | | 4/1998 | Loffler et al. | |
| 5,762,217 A | * | 6/1998 | Ohmi et al. | 215/253 |
| 5,782,369 A | | 7/1998 | Tansey | |
| 5,785,196 A | * | 7/1998 | Montgomery | 215/344 |
| 5,836,464 A | | 11/1998 | Druitt | |
| 5,875,909 A | | 3/1999 | Guglielmini | |
| 5,947,311 A | | 9/1999 | Gregory | |
| 6,095,359 A | * | 8/2000 | Richmond | 215/341 |
| 6,677,397 B1 | * | 1/2004 | Baranowski et al. | 524/488 |

FOREIGN PATENT DOCUMENTS

| | | | |
|---|---|---|---|
| DE | 196 24 039 A1 | | 6/1996 |
| GB | 2235186 | * | 2/1991 |
| JP | 9-216315 | * | 8/1997 |

OTHER PUBLICATIONS

Product Data Sheet/DARAFORM EXP 5162–65EG.

* cited by examiner

*Primary Examiner*—Nathan J. Newhouse

(57) ABSTRACT

A package made up of a container (30) with a closure assembly (10) applied thereto. The closure assembly has a molded plastic closure element (12) with a top panel (14) and an annular skirt (16) that depends downwardly from the. top panel and surrounds and engages a finish of the container. The closure assembly (10) also has a barrier disc (20) that underlies the top panel, but is out of engagement with a rim (32) of the container (30) when the closure assembly is applied to the container. The closure element has an integral sealing fin (22) with an inner end (24) as a first portion and an outer end (26) as a second portion, and the outer end, as molded, extends inwardly and downwardly from a distal end of the first portion. When the closure assembly is applied to the container, the second portion of the sealing fin is folded back toward the inner end of the sealing fin and engages the rim and a terminal side portion (34) of the finish of the container to form a top and side seal between the closure assembly (10) and the container (30). The outer end of the sealing fin also traps the sealing disc against the underside of the top panel of the closure but out of engagement with the container. The barrier disk disc is molded or fabricated from a material, for example, EVOH or LCP, that has excellent resistance to the permeation of $O_2$ or other gases therethrough, and may have an oxygen-scavenging material embedded therein when it is desired to use a closure assembly with such a barrier liner for the packaging of oxygen-sensitive materials, such as beer and other malt beverage products, dairy products and real juices.

12 Claims, 2 Drawing Sheets

CLOSURE WITH GAS-BARRIER LINER AND PACKAGE INCORPORATING SAME

FIELD OF THE INVENTION

This invention relates to a closure for application to a container for a gas-sensitive product, such as an oxygen-sensitive product. More particularly, this invention relates to a closure of the aforesaid character that has self-sealing characteristics to permit it to be applied to a pressurized or vacuum-packed product. The invention also relates to a package that includes a closure of the aforesaid character applied to and in combination with a filled container.

BACKGROUND OF THE INVENTION

Many products, such as beer and other malt beverage products, dairy products and real juices, must be packaged in such a way that oxygen cannot migrate into the package before the package is opened to permit consumption of its contents; otherwise, over the normal shelf life of the filled package oxygen will degrade the flavor of its contents. Heretofore, such products, when packaged in glass containers, or, more recently in plastic bottles, have been capped with a closure, such as an aluminum roll-on closure or a molded plastic closure, that is lined with an internal liner that functions both as a sealing liner and, to a lesser extent, an oxygen-barrier liner. Commonly-assigned U.S. Pat. No. 4,721,221 (Barriac), the disclosure of which is incorporated by reference herein, discloses a molded plastic closure with a molded plastic closure with a sealing liner, this reference teaching a top seal liner for pressurized beverage products. In either case, the liner must sealingly engage the rim of the associated container, either on its top or both on its top and side, to property seal the filled and capped container.

In recent years, there has been a concerted effort to eliminate the need for inserting a sealing liner in a molded plastic closure to eliminate the expense relating thereto. To that end, self-sealing molded plastic closures have been developed, and U.S. Pat. No. 5,638,972 (Druitt) and U.S. Pat. No. 5,836,464 (Druitt) the disclosure of each of which is also incorporated by reference herein, teach unlined, molded plastic closures of a general type that has proven to be quite successful in the packaging of carbonated soft drink products, which, though somewhat less sensitive to the migration of $CO_2$ out of the product, are not particularly sensitive to the migration of oxygen into the packaged product. However, such closures, as heretofore used in the packaging of carbonated soft drinks, are not sufficiently oxygen-impermeable to permit their use in the packaging of beer and other malt beverage products, and other oxygen-sensitive products, when such products must undergo a normal shelf life between packaging and opening for consumption.

BRIEF DESCRIPTION OF THE INVENTION

According to the present invention, there is provided a molded plastic closure with self-sealing properties when applied to a container for a product that is both pressurized and sensitive to oxygen or any other gas that would otherwise migrate through the closure into or out of a package made up a filled and closed container from a source external to such package. Such a package preferably is sealed against the top and side of its finish by a closure with an integral, internal sealing rib, such as that taught by the aforesaid Druitt '972 or '964 patents. Resistance to the migration of oxygen or other deleterious gases through the top panel of the closure into or out of the package is provided by inserting a liner with excellent gas impermeability properties against the underside of the closure top panel, at a location where the liner will not engage the rim of the associated container. Such a liner, because it does not function as a sealing liner, can be fabricated or formed from a material with excellent gas barrier properties, such as ethylene vinyl alcohol (EVOH) or a liquid crystal polymer polyester material (LCP), which have excellent gas-barrier properties, without regard to their physical sealing capabilities.

Accordingly, it is an object of the present invention to provide a molded plastic closure with improved resistance to migration of oxygen or other gases therethrough, and to provide a package with such a closure sealingly applied to a container. More particularly it is an object of the present invention to provide a molded plastic closure of the aforesaid character with self-sealing properties, and to provide a package with such a closure sealingly applied to a container.

For a further understanding of the present invention and the objects thereof, attention is directed to the drawing and to the following brief description thereof, to the detailed description of the preferred embodiment and to the appended claims.

DETAILED DESCRIPTION OF THE PREFERRED EMBODIMENT(S)

Figure 1:
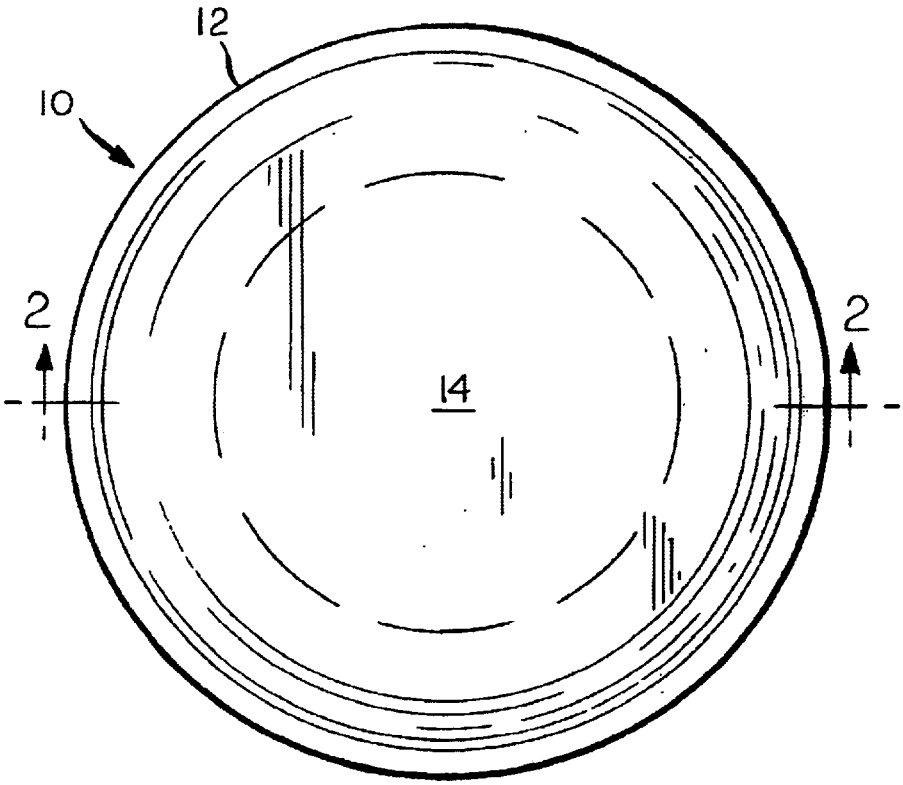
FIG. 1 is a plan view of a closure according to the preferred embodiment of the present invention.

A closure assembly according to the preferred embodiment of the present invention is identified generally by reference 10 in the drawing. The closure assembly 10 is made up of a generally cup-shaped closure element 12, which is made up of an imperforate top panel 14 with an annular skirt 16 depending downwardly from an edge of a the top panel 14. The closure assembly 10 also includes, as a separate element, a disc-shaped liner 20 that underlies the inwardly facing side of the top panel 14.

The closure element 12, which also has an inwardly projecting helical thread 18 for application to a glass or plastic bottle with an externally projecting helical thread on its neck or finish, is produced by injection or compression molding from a suitable thermoplastic material, for example, high density polyethylene, polypropylene, or low density polyethylene, or co-polymers of polyethylene and polypropylene. Unfortunately, such materials have low resistance to the permeation of gases therethrough, either oxygen from the atmosphere into the package or $CO_2$ or $N_2$ from the interior of the package to which the closure assembly is applied to its exterior. This problem is overcome by inserting the disc-shaped barrier liner 20 into the closure element 12.

The liner 20 is molded or fabricated from a material that has excellent resistance to the passage of gases therethrough, for example, EVOH (ethylene vinyl alcohol) or LCP (liquid crystal polymer), and these materials are especially resistant to the migration of oxygen therethrough. Resistance to the migration of oxygen into a container filled with an oxygen-sensitive product, such as beer or another malt beverage product, is especially important because of the propensity of oxygen to degrade the flavor of such a packaged product, and this factor may be enhanced by embedding oxygen-scavenging materials into the material from which the liner 20 is molded or fabricated. In that regard, known oxygen scavenging materials include that marketed by Darex Container Products of W.R. Grace & Co. of Cambridge, Mass. under the designation DARAFORM EXP 5162-65E6. In any case, such liner materials, with or without an oxygen scavenger also inhibit the outflow of $CO_2$ from a container filled with carbonated soft drinks, and the outflow of $N_2$ from plastic containers filled with still drinks, such as sports drinks, which are often pressurized with $N_2$ to rigidify an otherwise flexible container during shipment and handling. Further, a thin layer of a moisture barrier material, may, desirably, be provided over an inwardly-facing surface of the liner 20 when it is formed of a moisture-sensitive material, such as EVOH, and such covering layer may also have an oxygen-scavenging material embedded therein.

In the case of a closure assembly 10 intended for the packaging of a pressurized beverage, it is contemplated that the helical thread 18, which is shown as being continuous between its ends, may also be interrupted at various locations along its length, for example, in accordance with the teachings of U.S. Pat. No. 5,782,369 (Tansey), the disclosure of which is also incorporated by reference herein. In this case, it may also be preferred to provide a complementally formed helical rib on a container with an interrrupted thread.

Figure 2:
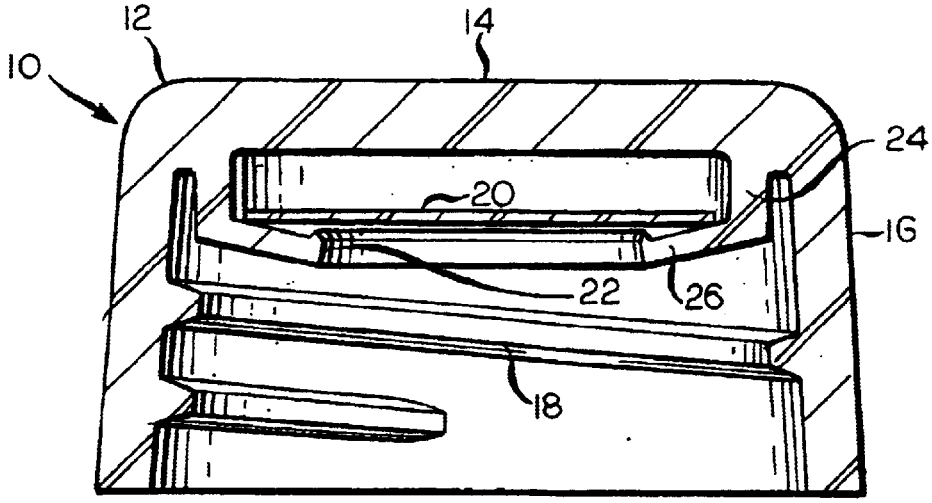
FIG. 2 is a sectional view taken on line 2—2 of FIG. 1.
Figure 3:
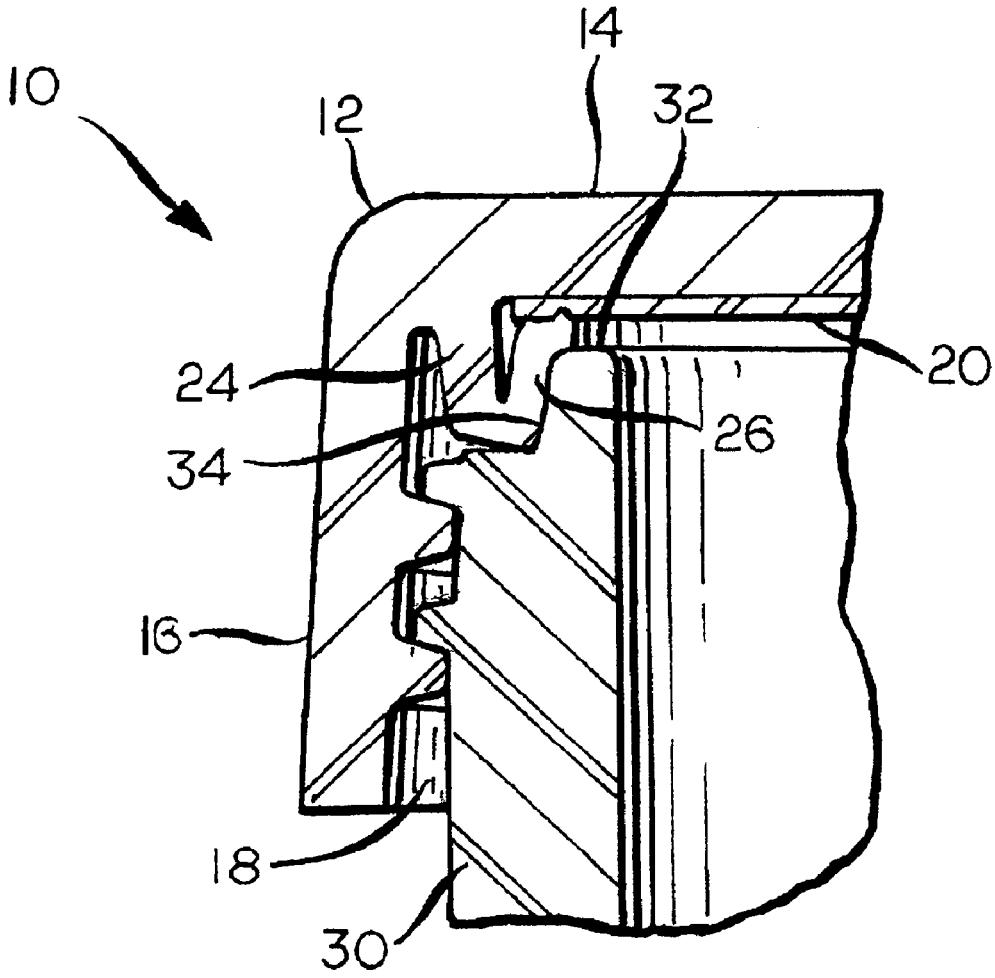
FIG. 3 is a fragmentary view, similar to FIG. 2, showing, in cross-section, the closure of FIGS. 1 and 2 applied to a finish of a bottle.

The closure element 12 has an integrally-molded sealing rib 22 that is molded concentrically with the annular skirt 16. The sealing rib 22 has an inner or root portion 22 that extends downwardly from the underside of the top panel 14 of the closure element 12 approximately parallel to the annular skirt 16, and a second portion 26 that extends downwardly from a distal end of the inner portion 24. The second portion 26 tapers inwardly and downwardly from the inner portion 24, and it has a distal end that defines an opening that is smaller than the liner 20. Thus, due to the flexibility of the sealing rib 22, it is possible to insert the liner 20 into the closure element 12 to the position depicted in FIG. 2, and the liner 20 will then remain in place until the closure assembly 10 is applied to a finish of a container 30, which is shown fragmentarily in FIG. 3.

In the application of the closure assembly 10 to the finish of the container 30, a rim or an annular surface 32 of the container 30 engages a free or distal end of the second portion 26 of the sealing rib 22 and forces it back towards the inner portion 24 of the sealing rib 22. Thus, an outer portion of the second portion 26 of the sealing rib 22 will form a pressure seal against the rim 32 of the container 30, and an inner portion of the second portion 26 of the sealing rib 22 will form a pressure seal against a terminal side portion 34 of the finish of the container 30. As a result, when the closure assembly 10 is applied to a container 30, there will be an effective top and side seal between the liner 20 of the closure assembly 10 and the container 30, and such a top and side seal is considered to be required for proper sealing of a pressurized container. The step of applying the closure assembly 10 to the container 30 will also trap the liner 20 between an upwardly facing surface of the outer portion 26 of the sealing rib 22 and an inwardly facing surface of the top panel 14 of the closure element 12. In this position, the liner 20 will be out of contact with all portions of the container 30, and will not participate in forming a seal between the closure assembly 10 and the container 30.

While not specifically shown, the lower, free end of the skirt 16 of the closure element 12 may be provided with a tamper-indicating band for engagement with a bead or other projection on the finish of a container, as taught, for example, by the aforesaid Barriac and Tansey patents.

Although the best mode contemplated by the inventors for carrying out the present invention as of the filing date hereof has been shown and described herein, it will be apparent to those skilled in the art that similar modifications, variations and equivalents may be made without departing from the scope of the invention, such scope being limited solely by the terms of the following claims and the legal equivalents thereof.

We claim:

1. A self-sealing, molded plastic closure assembly for application to a container for a pressurized or gas-sensitive product, said assembly comprising a closure, the container having a rim that defines an opening, said closure comprising:

a top panel that is adapted to span the opening of the container;

an annular skirt depending from the top panel and being adapted to secure the closure assembly to a finish of the container, the finish being below the rim; and an annular seating fin extending inwardly and downwardly from an interior of the closure and being formed integrally with the top panel and the annular wall of the closure, the sealing fin being adapted to engage a the rim of a the container to be folded into sealing engagement with the rim and a side of the finish of the container when the closure assembly is secured to the container;

said closure assembly further comprising:

a barrier disc inserted in said closure and positioned beneath an underside of the top panel of the closure and adapted to be out of sealing engagement with the rim of the container, the barrier disc being adapted to span the entirety of the opening defined by the rim of the container and to be retained within the closure assembly against the underside of the top panel solely by a folded back free end of the sealing fin when the sealing fin is in engagement with the rim of the container.

2. A closure assembly according to claim 1 wherein the barrier disc is molded or fabricated from a polymeric material whose primary ingredient is selected from the group consisting of EVOH and LCP.

3. A closure assembly according to claim 2 wherein the primary material also includes an oxygen-scavenging material embedded therein.

4. A closure assembly according to claim 1 wherein the closure is molded in a single piece from a material whose primary ingredient is selected from the group consisting of high density polyethylene, polypropylene, low density polyethylene, and co-polymers of polyethylene and polypropylene.

5. A closure assembly according to claim 1 wherein the closure is adapted to be applied to a container by providing the annular skirt of the closure with an inwardly projecting and helically extending continuous or interrupted thread.

6. A closure assembly according to claim 1 wherein:

said barrier disc is a molded or fabricated barrier disc.

7. A package comprising:

a container, said container having a finish with an annular rim; and a closure assembly applied to the container, the closure assembly comprising a closure, the closure comprising:

a top panel that spans an opening that is defined by the rim of the container;

an annular skirt depending from the top panel and serving to secure the closure assembly to the finish of the container, and an annular sealing fin having an inner portion that engages the rim of the container and a terminal portion of a side of the finish of the container, the sealing fin being formed integrally with the top panel and the annular wall of the closure;

said closure assembly further comprising:

a barrier disc inserted in said closure and positioned in engagement with an inwardly facing side of the top panel of the closure solely by a folded back free end of the sealing fin and out of sealing engagement with the rim of the container, the barrier disc spanning the entirety of the opening defined by the rim of the container and being contained within the closure assembly, when the closure assembly is in sealing engagement with the container.

8. A package according to claim 7 wherein:

the barrier disc of the closure assembly is molded or fabricated from a polymeric material whose primary ingredient is selected from the group consisting of EVOH and LCP.

9. A package according to claim 7 wherein the primary material of the barrier disc of the closure assembly also includes an oxygen-scavenging material embedded therein.

10. A package according to claim 7 wherein the closure is molded in a single piece from a material whose primary ingredient is selected from the group consisting of high density polyethylene, polypropylene and low density polyethylene, and co-polymers of polyethylene and polypropylene.

11. A package according to claim 7 wherein:

the closure is applied to the container by providing the annular skirt of the closure with an inwardly projecting and helically extending continuous or interrupted thread, and by providing the finish of the container with an outwardly projecting and helically extending continuous or interrupted thread.

12. A package according to claim 7 wherein:

said barrier disc is a molded or fabricated barrier disc.

* * * * *